US008752982B2

(12) United States Patent
Ng

(10) Patent No.: US 8,752,982 B2
(45) Date of Patent: Jun. 17, 2014

(54) MODULARIZED STREET LAMP

(71) Applicant: Amko Solara Lighting Co., Ltd., Taipei (TW)

(72) Inventor: Michael Ng, Taipei (TW)

(73) Assignee: Amko Solara Lighting Co., Ltd., Taipei (TW)

( * ) Notice: Subject to any disclaimer, the term of this patent is extended or adjusted under 35 U.S.C. 154(b) by 126 days.

(21) Appl. No.: 13/633,862

(22) Filed: Oct. 2, 2012

(65) Prior Publication Data

US 2013/0135867 A1 May 30, 2013

(30) Foreign Application Priority Data

Nov. 30, 2011 (TW) ..... 100222575 U

(51) Int. Cl.
*F21V 21/00* (2006.01)

(52) U.S. Cl.
USPC ..... 362/249.02; 362/249.01; 362/431

(58) Field of Classification Search
USPC ..... 362/249.02, 249.01, 431
See application file for complete search history.

(56) References Cited

U.S. PATENT DOCUMENTS

| | | | | |
|---|---|---|---|---|
| 7,918,580 | B2 * | 4/2011 | Liu | 362/218 |
| 7,926,982 | B2 * | 4/2011 | Liu | 362/294 |
| 8,454,194 | B2 * | 6/2013 | Liu | 362/218 |
| 8,550,659 | B1 * | 10/2013 | Lin et al. | 362/240 |
| 2006/0035511 | A1 * | 2/2006 | Mrakovich et al. | 439/404 |
| 2007/0153509 | A1 * | 7/2007 | Lehman et al. | 362/219 |
| 2007/0190845 | A1 * | 8/2007 | Mrakovich et al. | 439/404 |
| 2010/0172133 | A1 * | 7/2010 | Liu | 362/235 |
| 2012/0057344 | A1 * | 3/2012 | Wang | 362/235 |

* cited by examiner

*Primary Examiner* — Ali Alavi
(74) *Attorney, Agent, or Firm* — Leong C. Lei

(57) ABSTRACT

The present invention provides a modularized street lamp, which includes a lamp holder, a first light emission module, and a second light emission module. The first light emission module and the second light emission module are mounted to the lamp holder so that each of the light emission modules covers a respective area of illumination to achieve an effective distribution of areas of illumination. When one of the light emission modules gets broken, the remaining one of the light emission modules is still staying in operation to give off light to allow pedestrians to watch out any situation occurring in roads or streets. Further, the present invention can be manufactured in an easy way and includes no special configuration so that any manufacturer in the industry can easily manufacture the lamp to thereby ensure fairness of maintenance operations.

6 Claims, 9 Drawing Sheets

MODULARIZED STREET LAMP

(a) TECHNICAL FIELD OF THE INVENTION

The present invention generally relates to a street lamp, and more particularly to a modularized street lamp that combines a plurality of light emission modules.

(b) DESCRIPTION OF THE PRIOR ART

Street lamps are vital illuminating devices of roads and streets and function to provide illumination to the roads and streets when natural lighting is insufficient. However, the conventionally used incandescent lamps are known deficient in various aspects, such as lighting being excessively concentrated. Further, when a light bulb gets broken, the light goes directly off. This may result in unexpected hazard to pedestrians in case of insufficiency of lighting.

Further, the maturation of LED (Light-Emitting Diode) technology, which exhibits excellent advantages in respect of small volume, high efficiency, and reduced consumption of energy, makes the traditional illuminants, such as incandescent bulbs and mercury lights, gradually replaced by LEDs, which are now becoming a main stream in the future market. However, each manufacturer makes their own structures and specifications, whereby once the product of a specific manufacturer is used, repair and maintenance of such a product can only be done with spare parts available from the specific manufacturer. This causes unfairness to the general consumers.

SUMMARY OF THE INVENTION

To address such an issue, the present invention provides a modularized street lamp, which combines a plurality of light emission modules together such that each light emission modules illuminate an associated area and the sites of illuminated areas are well controlled. Further, when one of the light emission modules is broken, the remaining light emission modules continuously give off light, allowing pedestrians to clearly watch out any situation on the road or street. Further, the light emission module can be made easily and shows no special configuration so as to allow other manufacturers to manufacture by themselves and thus simplify subsequent operations of repair and maintenance and also ensure fairness in undertaking a maintenance project.

To achieve the above object, the present invention provides a modularized street lamp, which comprises a lamp holder, a first light emission module, and a second light emission module. The lamp holder is mounted to a lamp post and comprises a first socket and a second socket. The first light emission module comprises a first plate, a first illuminant, and a first plug. The first illuminant is arranged on one surface of the first plate. The first plug is mounted to the first plate and is insertable into the first socket to be electrically connected thereto. The first plug is electrically connected to the first illuminant. The second light emission module comprises a second plate, a second illuminant, and a second plug. The second illuminant is arranged on one surface of the second plate. The second plug is mounted to the second plate and is insertable into the second socket to be electrically connected thereto and is electrically connected to the second illuminant. The first light emission module and the second light emission module are respectively coupled to the first socket and the second socket and have preset areas of illumination that are different.

With the above described modularized street lamp, uniform illumination can be achieved so as to overcome the drawback of the known device for excessive concentration of lighting. Further, when one of the light emission module gets broken, the remaining one of the light emission modules remains in operation to give off light. Further, each of the light emission modules has a simple structure and any manufacturer in the industry can easily manufacture the modules. Thus, any public bidding held according to regulations can proceed without issuing any unfair competition.

Another object of the present invention is to include light emission modules set at different locations so as to expand the area of illumination.

A further object of the present invention is to make the first plate and the third plate having the same shape and the second plate and the fourth plate having the same shape so as to make manufacture easy and the manufacture cost lowered down.

Yet a further object of the present invention is to allow a fifth socket to be extended out of the lamp holder for use in case of additional light emission module being included.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
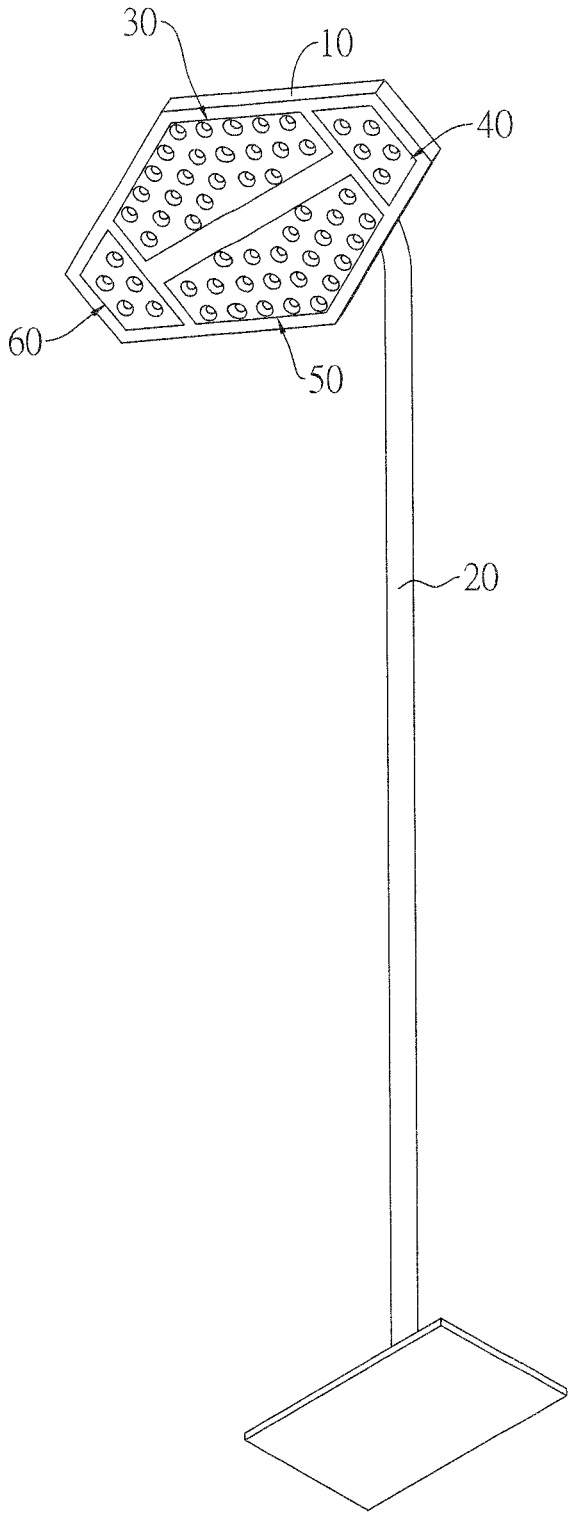
FIG. 1 is a perspective view showing an embodiment of the present invention.
Figure 2:
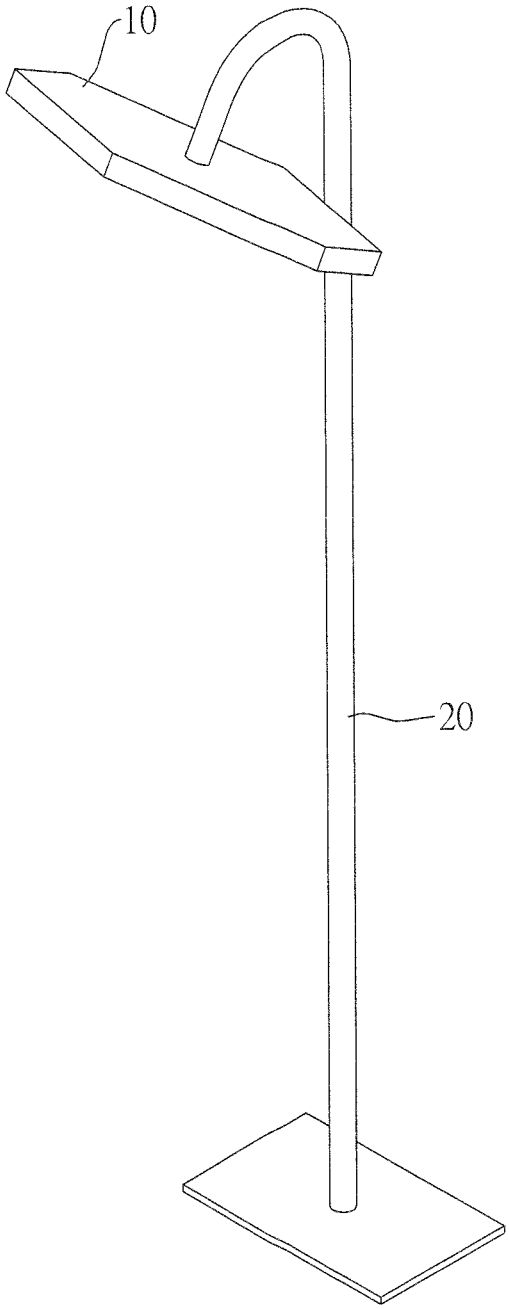
FIG. 2 is another perspective view of the embodiment of the present invention taken from a different angle.
Figure 3:
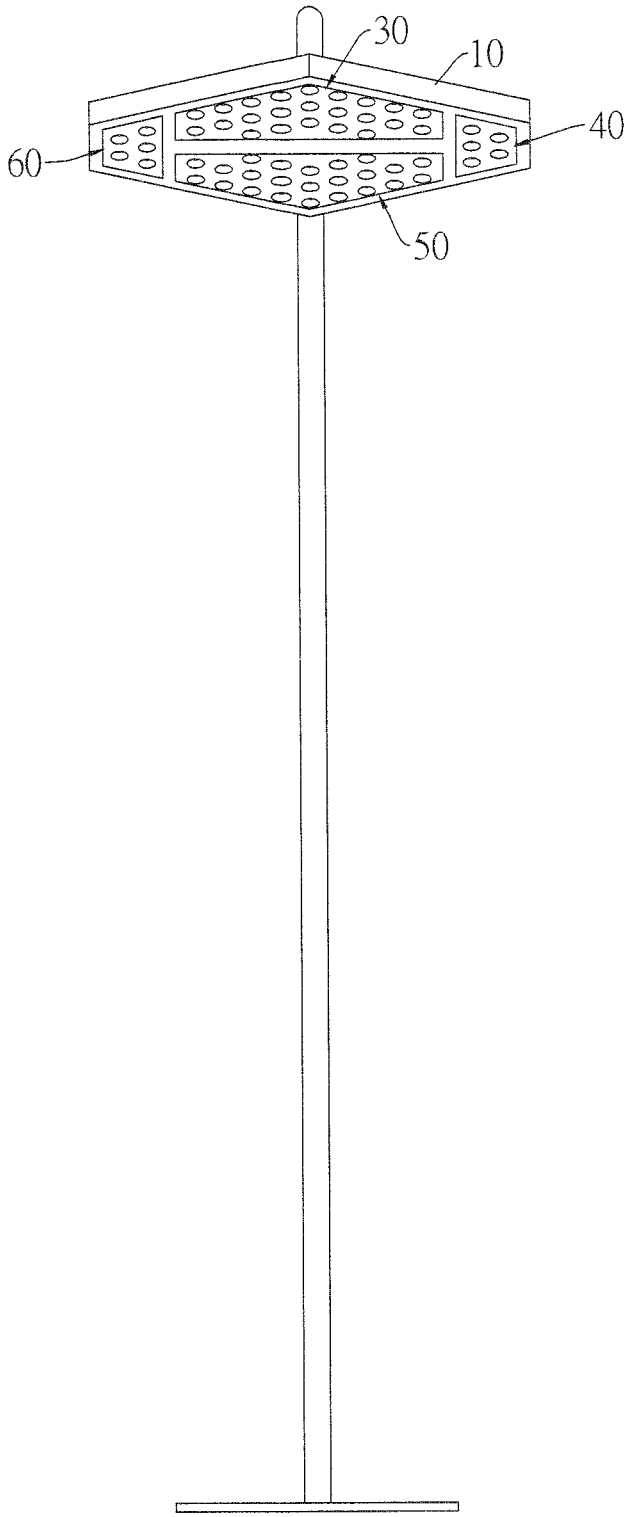
FIG. 3 is a front view of the embodiment of the present invention.
Figure 4:
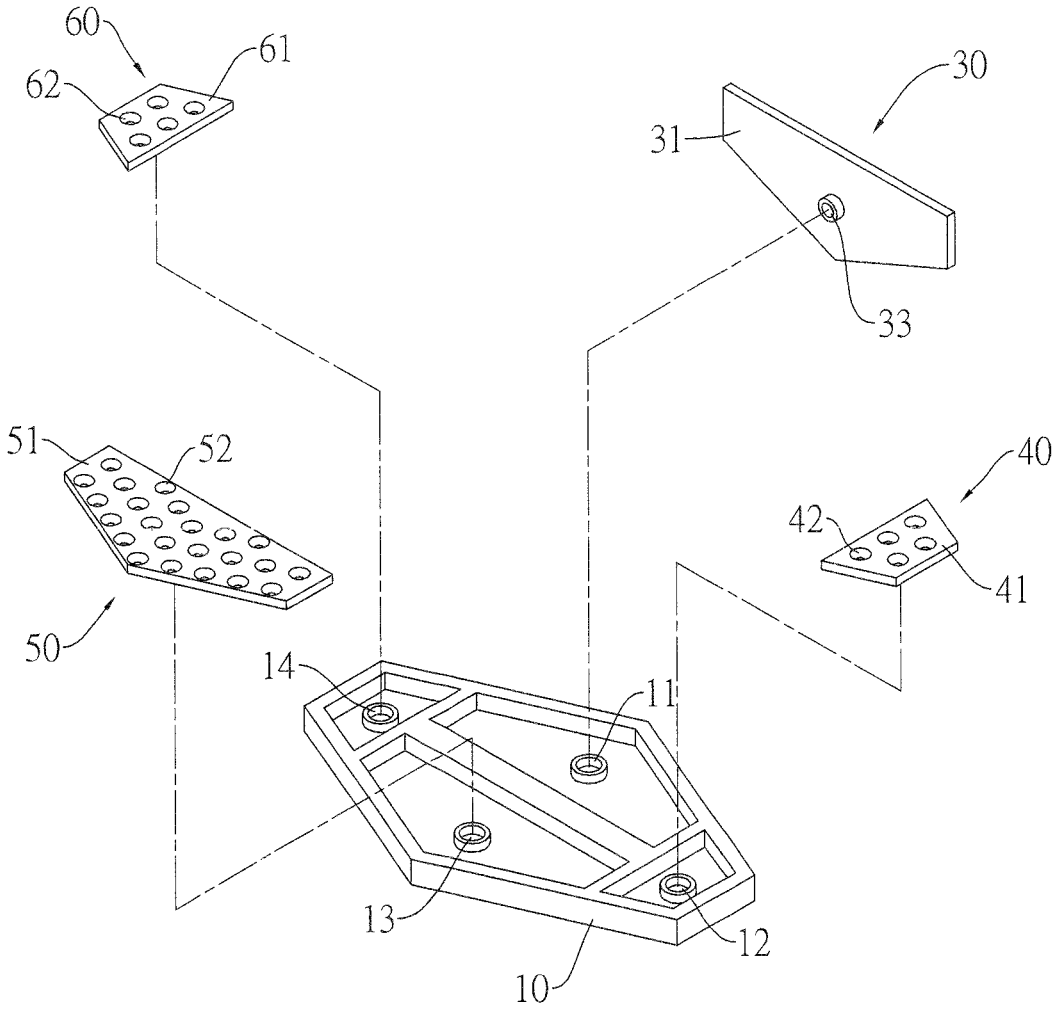
FIG. 4 is an exploded view of a lamp holder according to the embodiment of the present invention.
Figure 5:
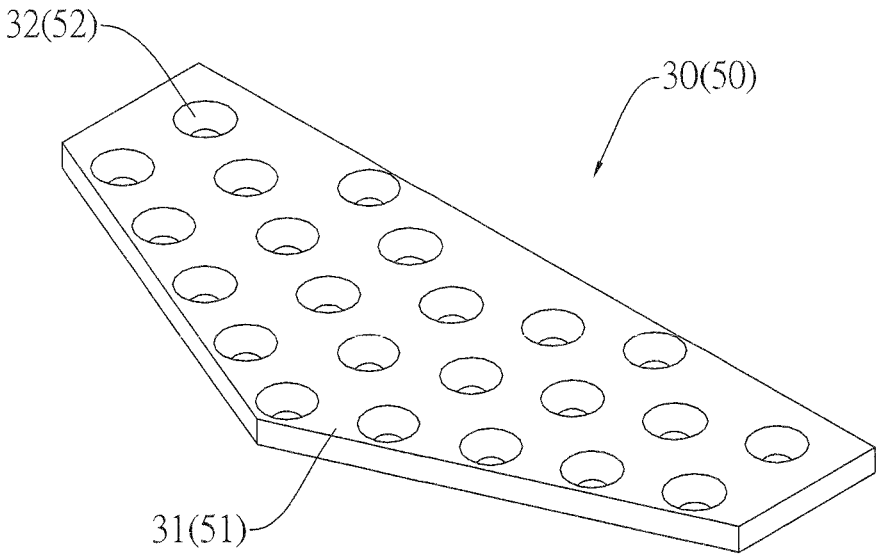
FIG. 5 is a perspective view showing a first light emission module (or a third light emission module) according to the present invention.
Figure 6:
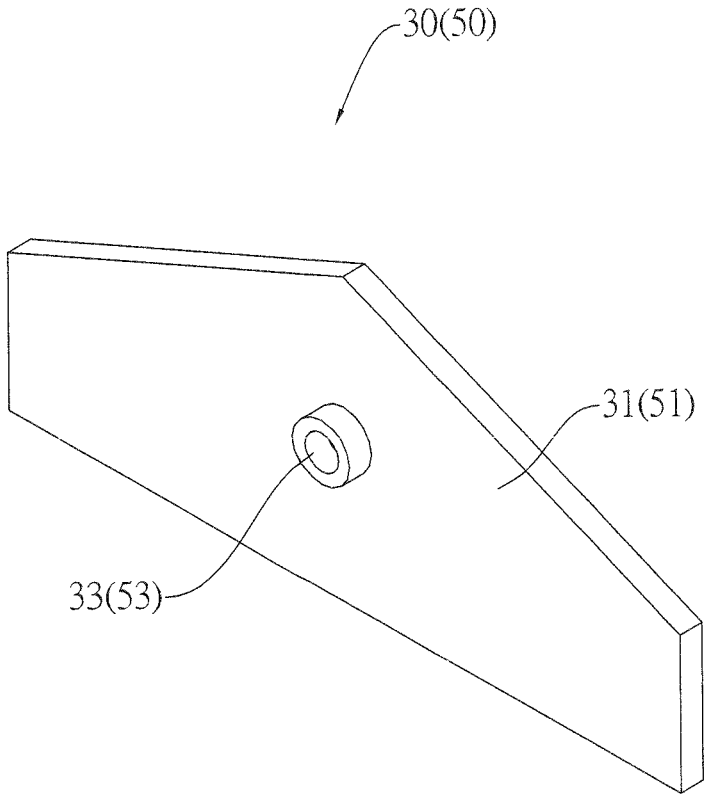
FIG. 6 is another perspective view of the first light emission module (or the third light emission module) according to the present invention taken from another angle.
Figure 7:
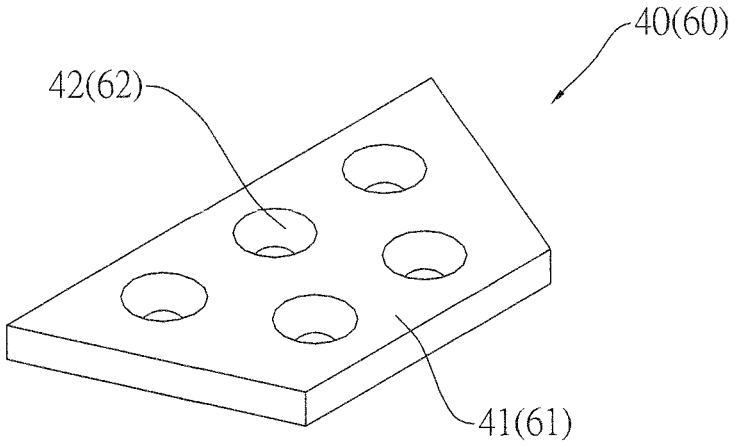
FIG. 7 is a perspective view showing a second light emission module (or a fourth light emission module) according to the present invention.
Figure 8:
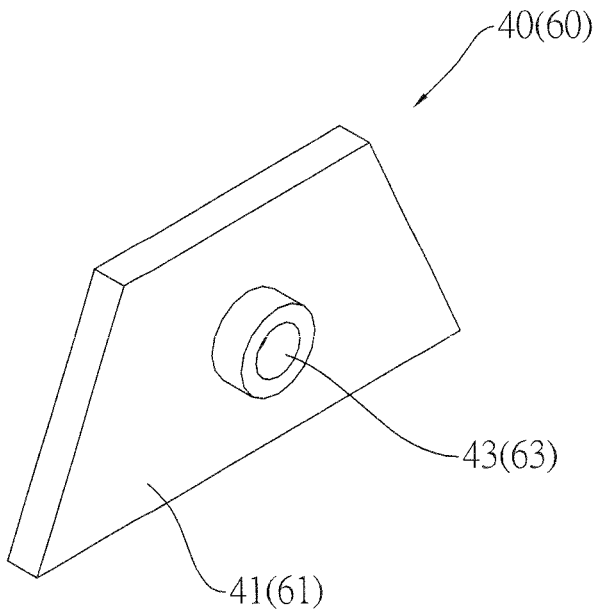
FIG. 8 is another perspective view of the second light emission module (or the fourth light emission module) according to the present invention taken from another angle.
Figure 9:
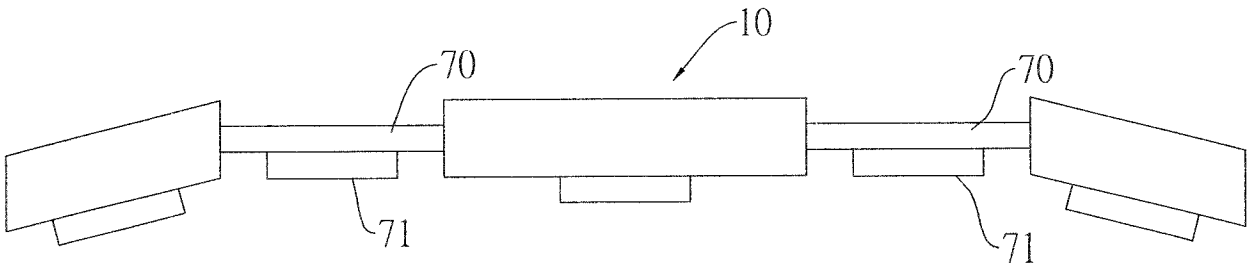
FIG. 9 is a schematic side elevational view illustrating extension of the lamp holder according to the embodiment of the present invention.

Referring to the drawings, FIG. 1 is a perspective view showing an embodiment of the present invention; FIG. 2 is another perspective view of the embodiment of the present invention taken from a different angle; FIG. 3 is a front view of the embodiment of the present invention; FIG. 4 is an exploded view of a lamp holder according to the embodiment of the present invention; FIG. 5 is a perspective view showing a first light emission module (or a third light emission module) according to the present invention; FIG. 6 is another perspective view of the first light emission module (or the third light emission module) according to the present invention taken from another angle; FIG. 7 is a perspective view showing a second light emission module (or a fourth light emission module) according to the present invention; FIG. 8 is another perspective view of the second light emission module (or the fourth light emission module) according to the present invention taken from another angle; and FIG. 9 is a schematic side elevational view illustrating extension of the lamp holder according to the embodiment of the present invention.

As shown in FIGS. 1-8, the present invention provides a modularized street lamp, which comprises a lamp holder 10, a first light emission module 30 and a second light emission module 40.

The lamp holder 10 is mounted to a lamp post 20 and comprises a first socket 11 and a second socket 12.

Referring to FIGS. 5 and 6, the first light emission module 30 comprises a first plate 31, a first illuminant 32, and a first plug 33. The first illuminant 32 is arranged on one surface of the first plate 31. The first plug 33 is mounted to the first plate 31 and is electrically connected to the first illuminant 32 and is insertable into the first socket 12 to be electrically connected thereto. When electrical power is supplied, the electrical power is fed through the first plug 33 to the first illuminant 32 to energize the first illuminant 32 for emission of light.

The second light emission module 40 comprises a second plate 41, a second illuminant 42 and a second plug 43. The second illuminant 42 is arranged on a surface of the second plate 41 and the second plug 43 is mounted to the second plate 41 and is electrically connected to the second illuminant 42 and is insertable into the second socket 43 to be electrically connected thereto. When electrical power is supplied, the electrical power is fed through the second plug 43 to the second illuminant 42 to energize the second illuminant 42 for emission of light.

The first light emission module 30 and the second light emission module 40 are set at predetermined angles and locations of illumination respectively so that the first light emission module 30 and the second light emission module 40 covers different areas of illumination. The first light emission module 30 and the second light emission module 40 may be set at desired angles or orientations to realize control of the areas of illuminations thereof.

The instant embodiment uses the first light emission module 30 and the second light emission module 40 to respectively illuminate different areas so as to make the distribution of light uniform. Further, when one of the first light emission module 30 and the second light emission module 40 get broken, the other one of the light emission modules is still in operation to give off light for illumination. This overcomes the deficiency of the conventional device that comprises only a single light source. Further, the first light emission module 30 and the second light emission module 40 are both easy to manufacture by those having ordinary skills in the art and the replacement of these modules is easy so that any subsequent maintenance operation can be opened to general manufacturers without causing any unfairness issue.

Further, the lamp holder 10 may further comprise a third socket 13 and a fourth socket 14 to be respectively used in combination with a third light emission module 50 and a fourth light emission module 60. The third light emission module 50 comprises a third plate 51, a third illuminant 52, and a third plug 53. The third illuminant 52 is arranged on one surface of the third plate 51 and is electrically connected to the third plug 53. The third plug 53 is mounted to the third plate 51 and is insertable into the third socket 13 to be electrically connected thereto. When electrical power is supplied, the electrical power is fed through the third socket 13 and the third plug 53 to the third illuminant 52. The fourth light emission module 60 comprises a fourth plate 61, a fourth illuminant 62, and a fourth plug 63. The fourth illuminant 62 is arranged on one surface of the fourth plate 61 and is electrically connected to the fourth plug 63. The fourth plug 63 is mounted to the fourth plate 61 and is insertable into the fourth socket 14 to be electrically connected thereto, whereby electrical power can be supplied through the fourth socket 14 and the fourth plug 63 to the fourth illuminant 62.

Further, the third light emission module 50 and the fourth light emission module 60 are set to cover different areas of illumination. Similar to the first light emission module 30 and the second light emission module 40 described above, various arrangements can be adopted to have the modules covering different areas of illumination so that uniformity of lighting can be achieved through proper coordination among these modules.

Referring to FIGS. 6-8, the first plate 31 and the third plate 51 can be made of the same shape, while the second plate 41 and the fourth plate 61 are of the same shape. This may simplify manufacturing thereof. Due to the shareability nature thereof, the number of spare parts can be reduced.

Further, as shown in FIG. 9, the lamp holder 10 further comprises an extension board 70 mounted inside the lamp holder 10. The extension board 70 comprises a fifth socket 71 mounted thereto. The extension board 70 is arranged so as to be withdrawable out of the lamp holder 10 to expose the fifth socket 15 to selectively receive one of the first light emission module 30, the second light emission module 40, the third light emission module 50, and the fourth light emission module 60 to insert therein. This allows the number of light emission modules to be modified according to the requirement of installation to ensure optimization of illumination.

In the instant embodiment, the first illuminant 32, the second illuminant 42, the third illuminant 52, and the fourth illuminant 62 can be any light emission elements, such as light-emitting diodes (LEDs) and fluorescent induction lamps. Further, additional devices or components, such as a heat sink, can be selectively mounted on the first plate 31, the second plate 41, the third plate 51, and the fourth plate 61.

The present invention may additionally comprise a photo sensor (not shown) mounted to the lamp holder 10 to control activation and deactivation of each light emission module. Further, a power generation device, such as a solar power generation device and a heat recovery based power generation device, can be combined with the present invention to generate electrical power by the lamp itself for supply to each of the light emission modules. In addition, an output device may be provided to supply the electrical power to other devices or facility.

Further, each light emission module may comprise a driving device, a controlling device, and a power conversion device that are directly coupled to the light emission module. This allows light emission modules of different powers to be combined in the same lamp holder 10. Alternatively, the driving devices, the controlling device, and the power conversion devices can be collectively and directly mounted in the lamp holder 10 or the lamp post 20 and this may simplify the manufacturing process of the light emission modules and lowers down the manufacture cost.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A modularized street lamp, comprising:

a lamp holder, which is mounted to a lamp post and comprising a first socket and a second socket;

a first light emission module, which comprises:

a first plate;

a first illuminant, which is arranged on one surface of the first plate; and a first plug, which is mounted to the first plate and is electrically connected to the first illuminant and is insertable into the first socket to be electrically connected thereto;

a second light emission module, which comprises:

a second plate;

a second illuminant, which is arranged on one surface of the second plate; and a second plug, which is mounted to the second plate and is electrically connected to the second illuminant and is insertable into the second socket to be electrically connected thereto;

wherein the first light emission module and the second light emission module are respectively coupled to the first socket and the second socket so that the first light emission module and the second light emission module cover different areas of illumination.

2. The modularized street lamp according to claim 1, wherein the lamp holder further comprises a third socket and a fourth socket.

3. The modularized street lamp according to claim 2 further comprising:

a third light emission module, comprising a third plate;

a third illuminant, which is arranged on one surface of the third plate; and a third plug, which is mounted to the third plate and is electrically connected to the third illuminant and is insertable into the third socket to be electrically connected thereto;

a fourth light emission module, comprising a fourth plate;

a fourth illuminant, which is arranged on one surface of the fourth plate; and a fourth plug, which is mounted to the fourth plate and is electrically connected to the fourth illuminant and is insertable into the fourth socket to be electrically connected thereto;

wherein the third light emission module and the fourth light emission module are respectively coupled to the third socket and the fourth socket so that the third light emission module and the fourth light emission module cover different areas of illumination.

4. The modularized street lamp according to claim 3, wherein the first plate and the third plate are of same shape and the second plate and the fourth plate are of same shape.

5. The modularized street lamp according to claim 4, wherein the lamp holder further comprises an extension board, which is mounted inside the lamp holder and forms thereon a fifth socket, the extension board being withdrawable out of the lamp holder to expose the fifth socket to receive insertion of one of a first light emission module, a second light emission module, a third light emission module, and a fourth light emission module therein.

6. The modularized street lamp according to claim 5, wherein the first illuminant, the second illuminant, the third illuminant, and the fourth illuminant comprise light-emitting diodes or fluorescent induction lamps.

* * * * *